United States Patent [19]

Lowe et al.

[11] Patent Number: 5,026,051

[45] Date of Patent: Jun. 25, 1991

[54] SOUND IMAGING APPARATUS FOR A VIDEO GAME SYSTEM

[75] Inventors: Danny D. Lowe; John W. Lees, both of Calgary, Canada

[73] Assignee: QSound Ltd., Calgary, Canada

[21] Appl. No.: 447,071

[22] Filed: Dec. 7, 1989

[51] Int. Cl.[5] ..... A63F 9/22

[52] U.S. Cl. ..... 273/435; 273/85 G; 273/DIG. 28

[58] Field of Search ..... 273/85 G, DIG. 28, 1 E, 273/148 B; 364/410; 381/1, 17, 63

[56] References Cited

U.S. PATENT DOCUMENTS

| | | | |
|---|---|---|---|
| 4,179,124 | 12/1979 | Margolin | 273/85 G |
| 4,305,131 | 12/1981 | Best | 273/DIG. 28 |
| 4,314,236 | 2/1982 | Mayer et al. | 273/DIG. 28 |
| 4,477,069 | 10/1984 | Crudgington, Jr. | 273/85 G |
| 4,574,391 | 3/1986 | Morishima | 273/85 G |
| 4,695,903 | 9/1987 | Serap et al. | 273/DIG. 28 |
| 4,890,833 | 1/1990 | Lantz et al. | 273/85 G |

FOREIGN PATENT DOCUMENTS

| | | | |
|---|---|---|---|
| 3238933 | 4/1984 | Fed. Rep. of Germany | 273/85 G |

*Primary Examiner*—Edward M. Coven
*Assistant Examiner*—Jessica Harrison
*Attorney, Agent, or Firm*—Lewis H. Eslinger; Jay H. Maioli

[57] ABSTRACT

A game software for a video game system includes sound positioning information that utilizes two spaced-apart speakers to give the player the impression that the sound is emanating from a location other than the actual speaker locations, for example, to the far right or the far left of the speakers. A sound processor operates in conjunction with a sound synthesizer similar to the one normally employed in a video game system to process the synthesized sound signals in accordance with the sound location information from the software so that it can be reproduced over the two speakers. By arranging the sound processor at various locations relative to the existing sub-systems of the video game, all existing and future video game systems can be adapted to utilize sound location information contained in the game software. In addition, synthesized sound signals from video game software that does not include sound positioning information can be enhanced.

9 Claims, 5 Drawing Sheets

10
GAME
12
52
32
34
50
56
54
24
26
28
36'
35'
58'
18'
20'
16'
36
35
58
18
20
16
20

SOUND IMAGING APPARATUS FOR A VIDEO GAME SYSTEM

BACKGROUND OF THE INVENTION

1. FIeld of the Invention

This invention relates generally to a sound system for a video game system and, more particularly, to a sound processing system that permits use of sound location information provided in the game software.

2. Description of the Background

Interactive video games have now become so well-known that practically everyone has either played such games or has seen others play them. Interactive video game systems may be small, compact units for use in the home or arcade-type games that require the use of coins to play. As is known, the player is provided with some sort of control, for example, a so-called joystick and one or more buttons, to interact with the game software and control the video display of the game. Some sort of audio program material is generally associated with the video display. To this date, such audio program material has been the weak sister of interactive video games, that is to say, the sounds that are attendant the video display have not been overly sophisticated. More recently, such sound material has been improved and some video game manufacturers are providing stereo sound to go along with the visual game display.

Generally, the video game audio program is produced over the loudspeaker that is integrally provided with the television receiver or monitor utilized for the video display and, in the case of video arcade games, speakers can be located directly in the free-standing game enclosure itself. Some video game systems for home use provide the capability for connection to the stereo music system that is generally found in most modern households.

Nevertheless, even though such audio program material has shown some improvement, it still lacks the sophistication necessary to add realism to the game and to provide additional involvement of the player with the game as it progresses. Furthermore, almost all enhanced game sound systems relate to adding-on conventional, available hardware that is intended to improve the sounds present in the games as originally designed and manufactured. This additional, conventional hardware involves more than a minimal expense, whether the attempted improvement relates to parts added by the user or added by the manufacturer of the video game.

OBJECTS AND SUMMARY OF THE INVENTION

Accordingly, it is an object of the present invention to provide a sound system for a video game system that is a marked improvement over such sound systems known heretofore.

Another object of the invention is to provide a sound system for a video game system that results in improved sound imaging and that operates on sound location information originally provided in the game software to give the game player the impression that the sounds ar emanating from points other than the actual location of the loudspeakers, for example, to the far left or far right of the speakers.

A further object of the present invention is to provide enhanced audio program material for a video game, in which sound location information contained in the game software is processed in the game base unit and is reproduced over two loudspeakers located on a stereo television, or over headphones or over other external speakers.

A still further object of the present invention is to provide an enhanced audio program for a video game in which sound location information included in the game software is subsequently processed in a sound processor located in an external unit that can be added to the existing video game system so that the processed audio material can be played back through stereo speakers typically found in a conventional television set, or over headphones, or other external speakers.

Another object of the present invention is to provide enhanced audio program material for a video game, in which sound location information contained in the game software is processed in the game control unit and played back to the user using two speakers located in the video game control unit itself.

According to an aspect of the present invention, sound location information and the appropriate audio cues for the sound synthesizer are pre-recorded or programmed in the video game cartridge at the time of its manufacture. Subsequently, upon the user playing the game, the audio cue information is fed to the sound synthesizer and signals representing the sounds according to the audio cues are produced. These signals and the sound location information from the game program are then fed to a sound processor that processes the synthesized monaural sound signals by using one or more specially derived sound processing transfer functions to produce two-channel sound information that is then played back by a two-channel speaker system, either in the existing television receiver or monitor, or a separate stereo sound system, or through earphones, or through two speakers mounted in the player control unit of the video game system.

The above and other objects, features, and advantages of the present invention will become apparent from the following detailed description of illustrated embodiments thereof to be read in conjunction with the accompanying drawings, in which like reference numerals represent the same or similar elements.

DETAILED DESCRIPTION OF PREFERRED EMBODIMENTS

In U.S. patent application Ser. No. 239,981, filed Sept. 2, 1988 and assigned to the assignee hereof, a sound imaging process is disclosed, whereby upon utilizing appropriate transfer functions to process a monaural audio signal a two-channel sound signal is produced that has its differential phase and amplitude adjusted on a frequency dependent basis to produce a sound that is apparently located at a position other than the location of the speakers, for example, to the far right or far left of the speakers, or up or down, or even behind the listener. The phase and amplitude adjustments are made individually for successive frequency bands over the audio spectrum. The disclosure of the above-identified patent application is incorporated herein by reference. More specifically, the sound processing system of that above-referenced patent application can, by utilizing suitable transfer functions as might be embodied in a digital filter, receive a single channel audio signal and produce two signals therefrom, wherein the differential amplitude and phase is adjusted over the entire audio spectrum.

Each discrete location of the apparent point from which the sound is emanating can be produced by an individual transfer function determined utilizing a empirical method. Thus, assuming one were facing two speakers directed generally outwardly and the center point between the speakers is considered to be 12 o'clock on a clock face, then it is possible to make the sound appear to the listener to be emanating from a point at 3 o'clock or 9 o'clock, or, indeed, 6 o'clock and, furthermore, the elevation of the apparent sound source can be adjusted as well.

Of course, it is understood that there are several monaural output channels from the sound synthesizer, each of which is processed according to the sound processing system according to the above referenced patent application.

Figure 1:
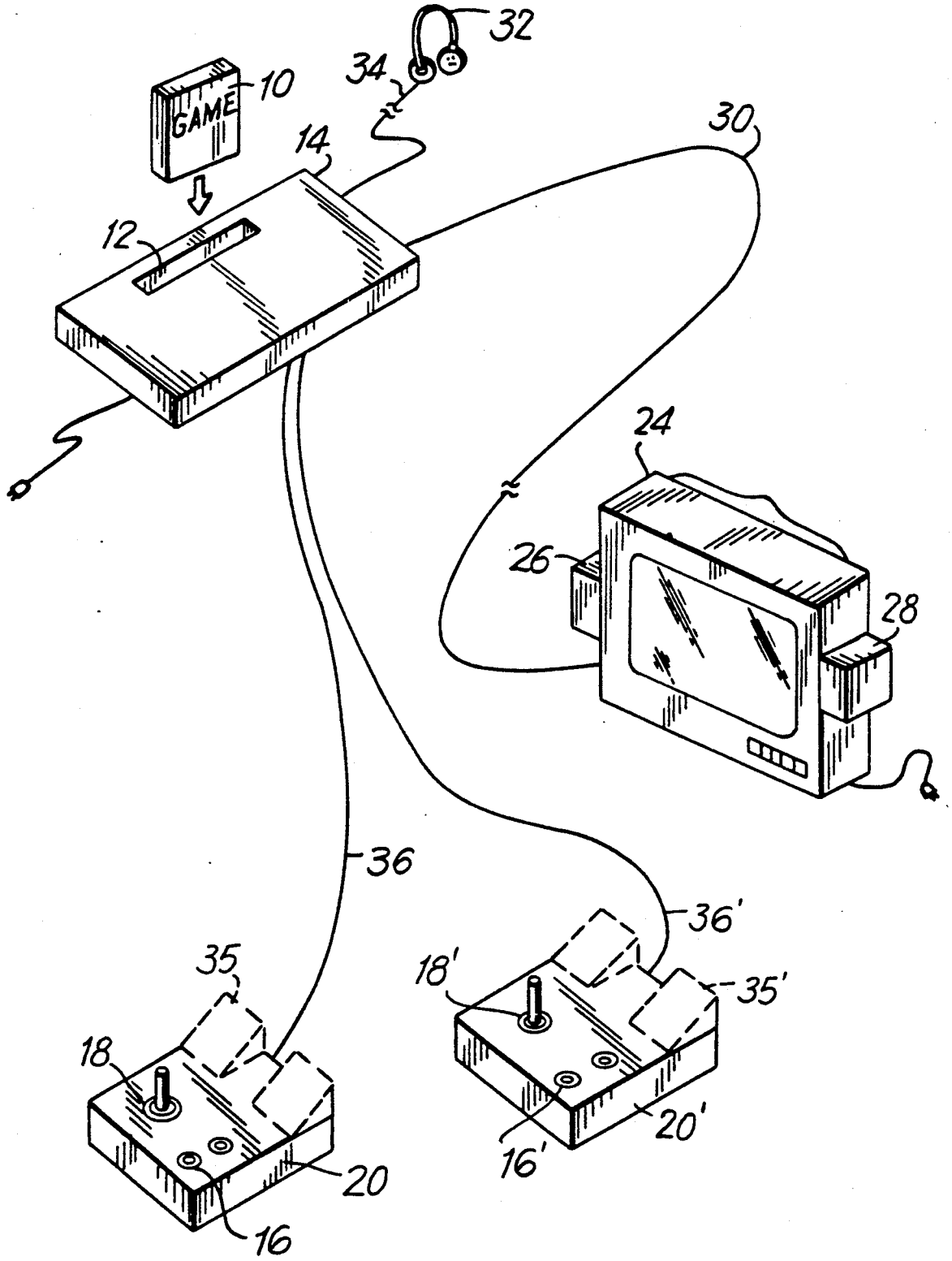
FIG. 1 schematically illustrates a video game system according to an embodiment of the present invention in which the sound processor is located internally in the video game base unit, with the sound being produced by two speakers associated with the video monitor or over headphones.

Accordingly, the present invention is based upon the utilization of that sound imaging process in the video game environment. More specifically, as represented in FIG. 1, a game cartridge 10 is generally adapted to be inserted into a slot 12 formed in a video game base unit 14. In this system of FIG. 1, the game cartridge 10 includes sound location information that permits utilization of the principles of the above-identified patent application, along with the typical sound program material in the form of cues for a sound synthesizer that are normally included.

In regard to such sound location information, it must be first noted that game cartridges can include three kinds of sound information. First, some game cartridges provide stationary sounds that may relate to the background environment of the game or may include musical sounds that are reproduced by the synthesizer while the game is being played. Some game cartridges also include dynamic sounds that are related to the particular picture being provided on the video monitor. For example, in the event of a picture being displayed that relates to a thunderstorm, such dynamic sounds might include sounds of thunder. Finally, some video game cartridges provide dynamic sounds that are created by actions of the game player, for example, the player may create the sound of gun fire or the like by utilizing buttons, shown typically at 16, or a joystick 18 located at the player control unit 20. There ar occasions where two remote control units are provided and generally such units are identical, with the second one shown in FIG. 1 at 20' having buttons 16' and joystick 18'.

Thus, it is seen that at least three different classes of sound can be made available on a typical game cartridge. Nevertheless, by following the teaching of the above-referenced patent application, relating to sound image processing, and the present invention the apparent location to the listener of all three of these different sounds can be controlled. That is, assuming in the embodiment of FIG. 1 that a video monitor 24 is provided with left and right channel speakers, 26 and 28, respectively, and that the monitor 24 is connected to the video game base unit 14 by a cable 30, then upon the output of the sound following the processing of the sound location information derived from the game cartridge 10 in the sound processor (not shown in FIG. 1) located in video game monitor 24 can have the impression that the sound is emanating from locations either behind video monitor 24, to the left of speaker 26 or the right of speaker 28 or, in fact, behind the actual game player. The video signals for the game ar also fed to monitor 24 over cable 30.

In the event that the game player does not wish to employ speakers 26, 28 of video monitor 24 but instead desires to utilize earphones, then such earphones 32 are typically connected to a jack provided on video game base unit 14 by a cable 34. Upon plugging in earphones 32 the audio signal to the monitor speakers 26, 28 will be disconnected, and the sound will be reproduced over earphones 32, and it will still produce the sound imaging to the listener in accordance with the sound positioning information originally contained in game cartridge 10.

In accordance with another aspect of the present invention the player control unit 20 can be provided with individual speakers, shown in phantom at 35, and the sound produced over those speakers 35 instead of over the video monitor speakers. This embodiment will be described in detail in FIG. 3.

Figure 2:
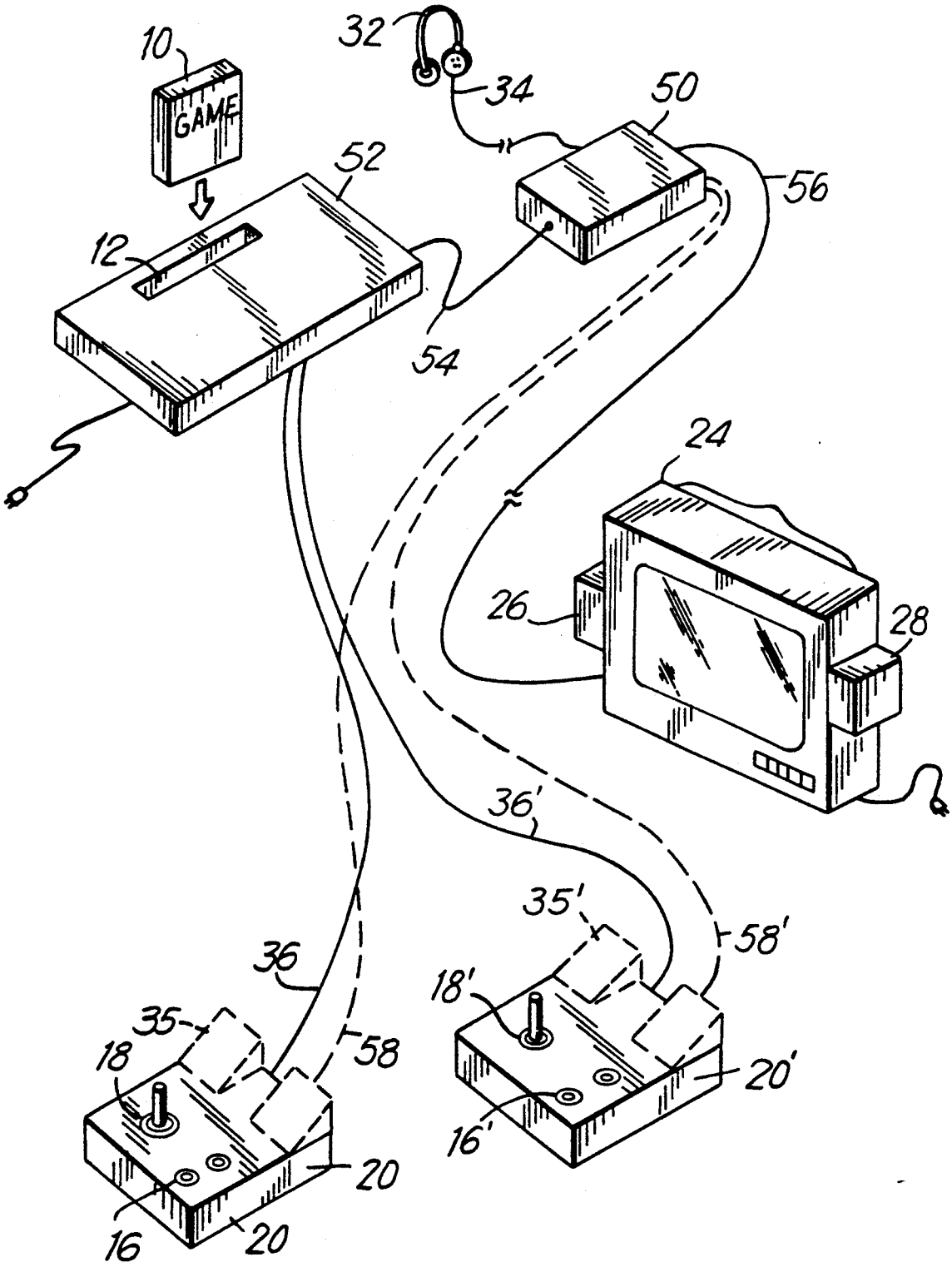
FIG. 2 schematically illustrates another embodiment of the present invention in which the sound processor is located as an outboard unit, with the enhanced sound being produced by the speakers associated with the video monitor or over headphones.

The manner in which the sound processor and the various video game subsystems are electrically connected within the base unit, for example, will be described in more detail in regard to FIG. 4, however, FIG. 2 shows the external connections involved where the sound processor system 50 is a separate unit located outside of game base unit 52. In the embodiment of FIG. 2, game cartridge 10 is generally the same as in the embodiment of FIG. 1 and contains the sound positioning information that might relate to any or all of the three classes of sound information described above. The sound synthesizer unit that is internal to all video game base units is generally not appropriate for connection to the sound processor and a separate sound synthesizer is also provided in sound processor system 50. Then the outputs from the separate sound synthesizer (not shown) can be fed directly to the sound processor. The audio cues for the sound synthesizer and the sound location information can be fed on multi-line cable 54 to sound processor system 50. Using the sound processor the monaural audio signals from the separate synthesizer are each converted to two-channel sound signals that have a differential phase and amplitude on a frequency dependent basis in accordance with the processing information originally in cartridge 10 for subsequent reproduction over two speakers 26, 28 of video monitor 24 or over earphones 32, which can be connected directly to sound processor system 50. To simplify the connection of sound processor system 50 into the existing video game system, the video information from base unit 52 can also be fed out on cable 54 and passed directly through sound processor 50 for feeding to monitor 24 on cable 56.

In a further variation of the embodiment, in the event that each player control unit includes integral speakers (shown in phantom in FIG. 2 at 35), then external sound processor system 50 can be connected to remote control units 20, 20' via two conductor cables 58 and 60, respectively, shown as dashed lines in FIG. 2, in which case the control units would not be connected to base unit 52 over cables 36, 36'.

Figure 3:
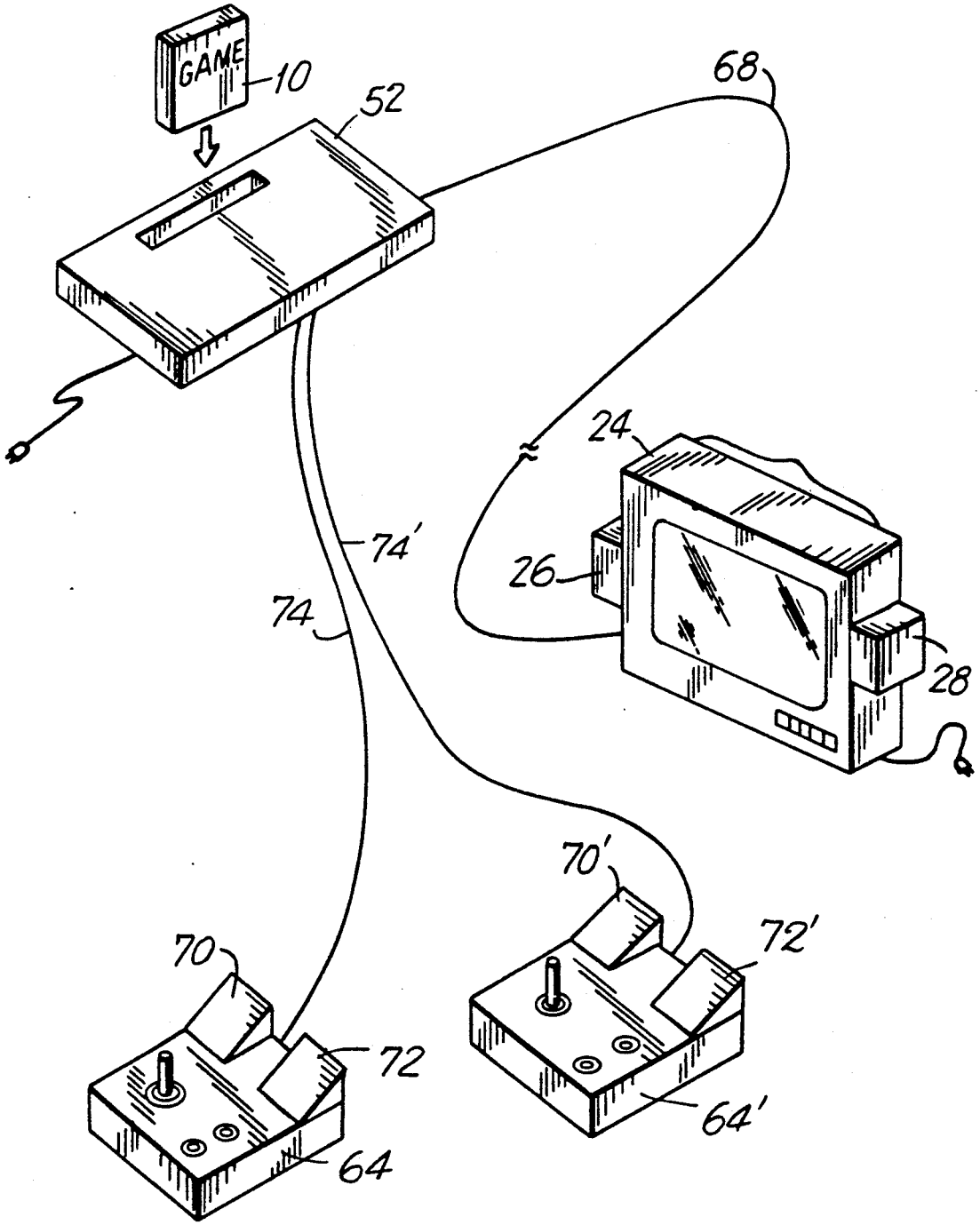
FIG. 3 schematically illustrates still another embodiment of the present invention in which the sound processor unit is located in a player-operated control unit, with the sound being played back over two speakers arranged in that control unit.

FIG. 3 shows yet another arrangement according to the present invention, whereby sound location information contained in video game cartridge 10 for playback through base unit 52 is processed utilizing a sound processor (not shown) located inside player control unit 64. The sound synthesizer unit that is internal to all video game base units is not appropriate for connection to the sound processor and a separate sound synthesizer is provided in the player control unit 64. As in the previous embodiments, the video game can employ two identical player control units 64 and 64', in which case a sound synthesizer and sound processor unit are located in each control unit. Each player control unit 64, 64' is provided with two speakers 70, 72 and 70', 72', respectively, and is connected to base unit 52 by cable 74, 74', respectively. In the embodiment of FIG. 3, the video monitor 24 is connected by a cable 68 to the game base unit 52 that provides the video signal for display. As in the embodiment of FIG. 2, game base unit 52 does not contain the sound processor and, thus, remains substantially unmodified.

Figure 4:
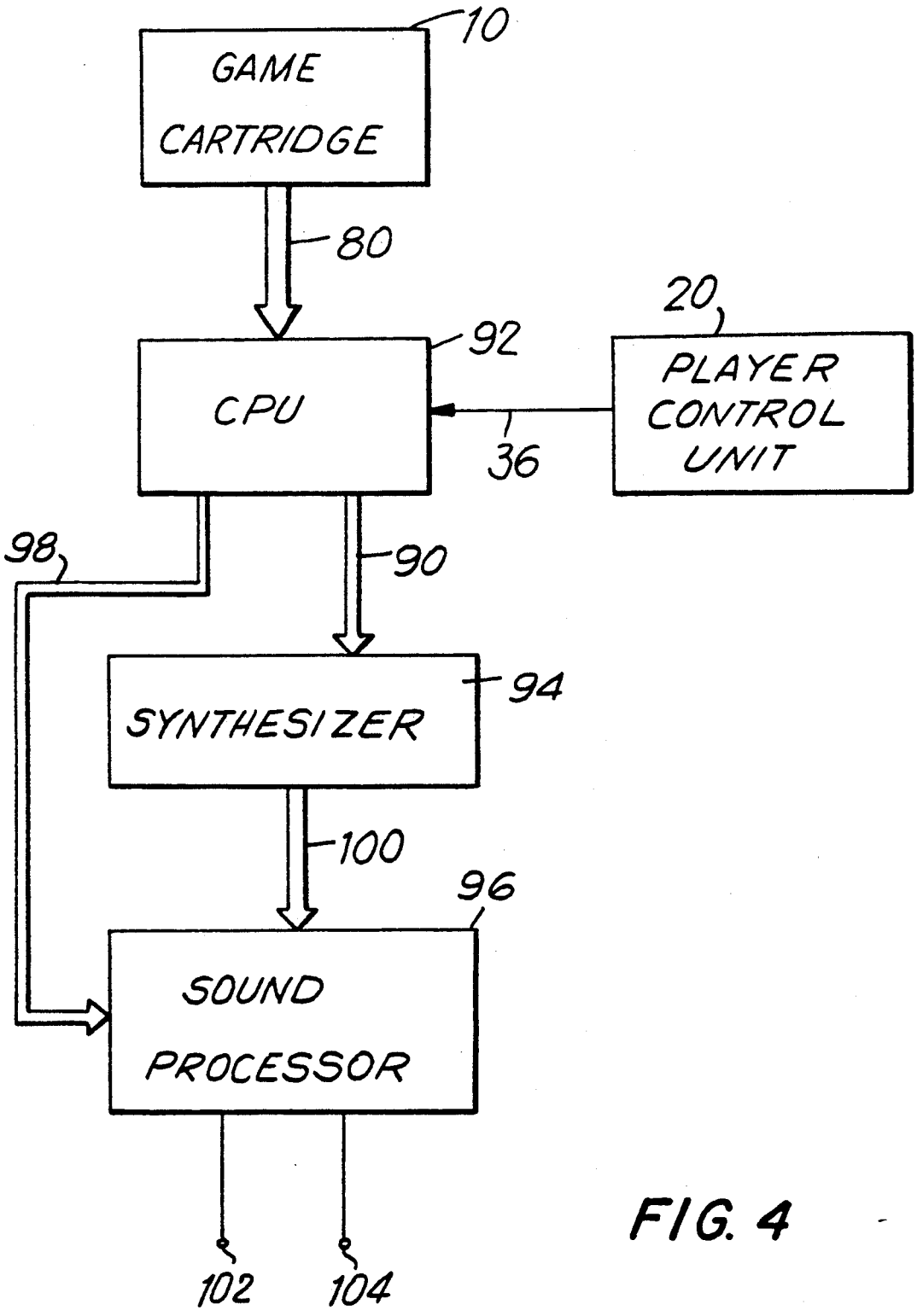
FIG. 4 is a schematic in block diagram form showing the sound processor electrically connected to the conventional elements of a video game system according to one embodiment of the present invention.

Turning now to FIG. 4, the circuit construction and arrangement of the sound processor and the typical subsystems of a video game system according to the embodiment of FIG. 1 described above are shown in detail. More specifically, video game cartridge 10 is generally provided with multiple electrical contacts represented by parallel-path arrow 80. Upon insertion of the cartridge 10 into the game base unit it is connected to the CPU bus of a central processing unit (CPU) 92, which forms a part of the microcomputer that is typically the heart of all video game systems. The central processing unit 92 is of known construction and the information from the game cartridge is off-loaded and decoded by central processing unit 92. Although CPU 92 performs many tasks relative to the video game, because the audio portion is the area of interest in the instant invention only those subsystems relating to that portion of the game will be shown in FIG. 4. The decoded audio information from game cartridge 10 is fed to a sound or audio synthesizer 94 on bus 90 where the decoded commands or cues are utilized to produce the various sounds employed in the video game. Up to this point, all of these elements are present in every standard, interactive video game system. According to the present invention, however, the game cartridge 10 is also provided with sound location information, such as that according to the above-referenced patent application, in addition to the normal sound information such as the background sounds, the dynamic sounds, and the like. This sound information is fed from CPU 92 to a sound processor 96 on bus 98. The normal sound information produced by synthesizer 94 is supplied as monaural sound signals on bus 100 to sound processor 96. Sound processor 96 contains at least one specialized transfer function constructed according to the above-referenced patent application in order to position the apparent source of each monaural sound signal relative to the actual location of the two speakers. Such transfer function might be embodied by a digital filter and, for example, one such filter in sound processor 96 might contain a suitable transfer function for positioning the sound at 3 o'clock. Then, upon a suitable command appearing on bus 98, the two-channel sound signal at terminals 102, 104 will appear to the listener to be emanating from a point in space corresponding to the right of the speakers. It is understood that this explanation relates only to a single, monaural output from the sound synthesizer and that the signals at terminals 102, 104 are actually the sum of all of the outputs from the sound synthesizer.

Accordingly, the sound information produced by synthesizer 94 is processed in a digital filter, for example, in sound processor 96 according to predetermined transfer functions and the output of sound processor 96 is then the two-channel sound signal present on line 30 of the embodiment of FIG. 1, for example. The important criterion is the specific differential relationship of the phase and amplitude on a frequency dependent basis between the two output signals for a selected sound position. This information at output terminals 102 and 104 can be denoted as left and right, however, the output signals produced do not necessarily correspond to the well-known stereo signals.

On the other hand, a separate synthesizer and sound processor can be located together in the outboard unit 50 of the embodiment of FIG. 2, or a separate synthesizer and sound processor can both be located in the hand-held control unit 64 of FIG. 3.

Figure 5:
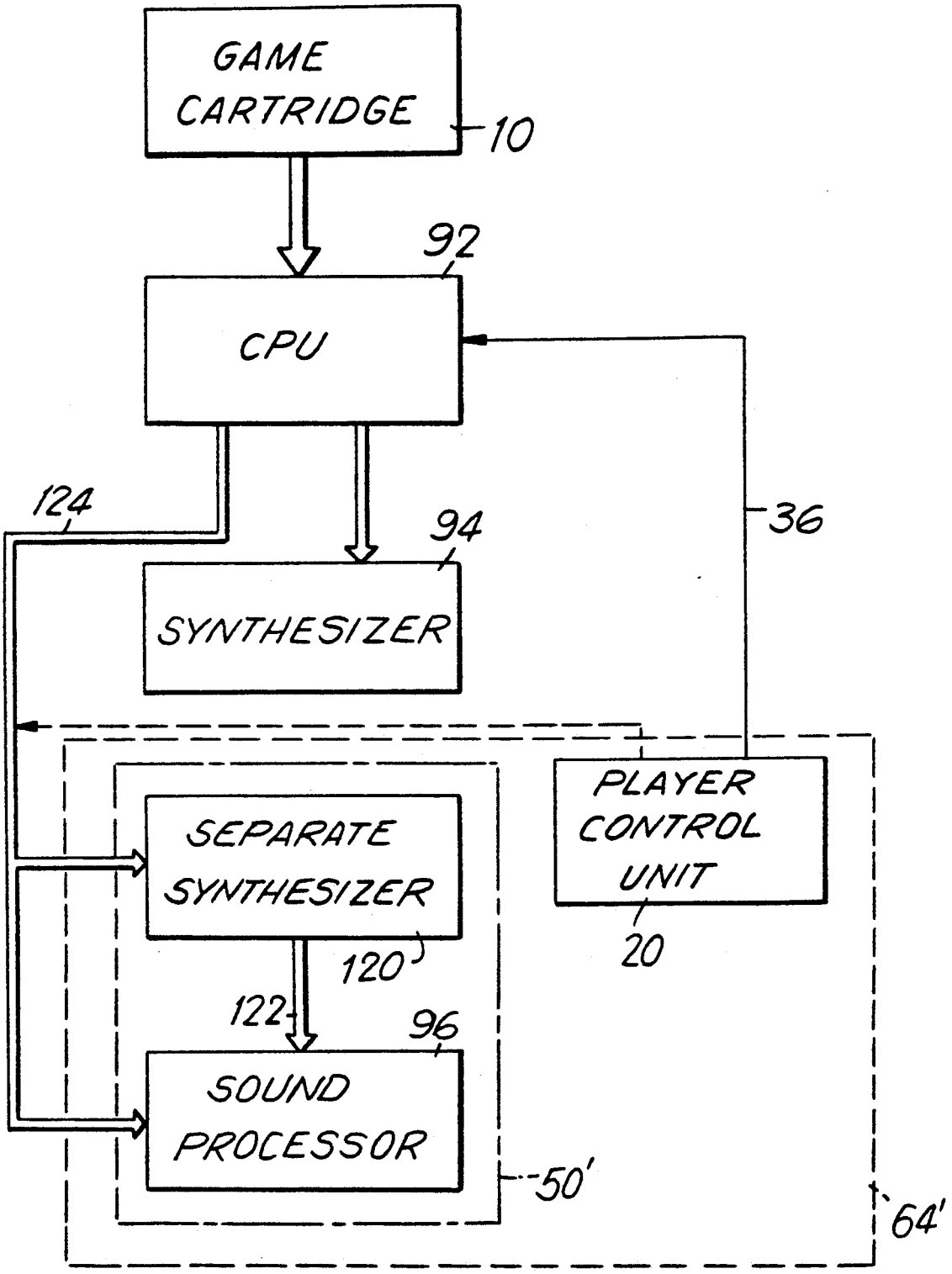
FIG. 5 is a schematic in block diagram form showing the sound processor and separate synthesizer electrically connected to the conventional elements of a video game system according to another embodiment of the present invention.

These embodiments are represented in FIG. 5, in which the locations and connections of the add-on units are shown relative to the conventional video game subsystems. As noted above, because the original sound synthesizer is not appropriate for use in such embodiments a separate synthesizer must be employed. Such separate synthesizer is shown at 120 in FIG. 5 and is connected to sound processor 96 through bus 122 and to CPU 96 through bus 122 and to CPU 92 through bus 124, which is also connected to sound processor 96 for communication with CPU 92.

In the embodiment of FIG. 2, the player control unit 20 is simply connected to CPU 92 by line 36 or it is connected to the outboard unit 50 by line 58. The outboard unit 50 containing synthesizer 120 and sound processor 96 are shown enclosed by dot-dash line 50' in FIG. 5.

In the embodiment of FIG. 3, the separate synthesizer 120 and the sound processor 96 are contained with the player control unit 64, as represented in FIG. 5 by dashed line 64'.

The above description is given on preferred embodiments of the invention, but it will be apparent that many other modifications and variations could be effected by one skilled in the art without departing from the spirit or scope of the novel concepts of the invention, which should be determined by the appended claims.

For example, although the present invention is intended for use with video game software containing sound location information, beneficial results are also obtained by processing the sound program material normally provided in such video game software. One such approach is to divide a monaural signal from the synthesizer into two identical signals corresponding to left and right stereo signals and to use the sound processor to position the left channel signal outside of the left speaker and to position the right channel signal outside of the right speaker to create a sound image that surrounds the game player. In such case, one of the channels is delayed relative to the other to differentiate the two signals.

What is claimed is:

1. An interactive video game system, including a central processing unit, for displaying and controlling a video game display on a video monitor, and including an associated audio program for driving a sound synthesizer to produce audio signals, comprising:

a pair of audio transducers in spaced-apart relationship for receiving audio signals and reproducing the audio program;

a single game cartridge containing interactive video game play data and containing the associated audio program including sound positioning data of the kind for positioning a sound to appear to a listener to be at a location other than the locations of said pair of audio transducers;

a control unit including a housing for use by a player playing the interactive video game;

first and second bus means;

a game console connected to said control unit and including means whereby the central processing unit is electrically connected to said game cartridge inserted therein for operating on said game play data and audio program data for subsequent display on the video monitor and playback on said audio transducers, respectively;

a second, separate, sound synthesizer arranged in said control unit housing and receiving the audio program data from the game cartridge through said first bus means from the central processing unit and producing a plurality of monaural sound signals therefrom within the audio frequency band; and sound position processing means also arranged in said control unit housing and connected to receive said plurality of monaural sound signals from said second, separate, sound synthesizer means over said second bus means and said sound positioning data from said game cartridge over said first bus means for producing therefrom two-channel audio output signals having differential amplitude and phase therebetween in accordance with a predetermined frequency dependent transfer function of said sound position processing means, said two-channel audio output signals being fed respectively to said pair of audio transducers for playback.

2. An interactive video game system according to claim 1, wherein said pair of audio transducers are attached to said control unit housing in said spaced-apart relationship.

3. An interactive video game system according to claim 1, wherein said pair of audio transducers are arranged in said spaced-apart relationship on either side of the video monitor.

4. An interactive video game system according to claim 1, wherein said pair of audio transducers comprise a set of headphones.

5. An interactive video game system, including a central processing unit, for displaying and controlling a video display on a video monitor including reproducing an associated audio program on a pair of audio transducers, in which a single game cartridge contains interactive video game play data including graphics data and contains associated audio program data including sound positioning data of the kind for positioning a sound to appear to a listener to be at a location other than the location of the pair of audio transducers, the system comprising;

a player control unit having a housing and a manually operable switch, whereby a player playing the interactive video game controls events in the game;

means for mounting the pair of audio transducers in spaced-apart relationship on said control unit housing facing the player playing the game;

game console means connected to said control unit and including at least the central processing unit electrically connected to the game cartridge and operating on the game play data and on the audio program data for display on the video monitor and playback over respective ones of the pair of audio transducers;

sound synthesizer means receiving the audio program data from the game cartridge through the central processing unit and producing at least one monaural sound signal therefrom within the audio frequency band; and sound position processing means connected to receive said at least one sound signal from said sound synthesizer means and said sound positioning data from the game cartridge for producing therefrom two-channel audio output signals having a differential amplitude and phase relationship in accordance with a predetermined frequency dependent transfer function contained therein, said two-channel audio output signals being fed to the pair of spaced-apart audio transducers facing the player.

6. An interactive video game system according to claim 5, further comprising an outboard housing wherein said sound synthesizer means and said sound position processing means are arranged within said outboard housing.

7. An interactive video game system according to claim 5, wherein said sound synthesizer means and said sound position processing means are arranged within said control unit housing.

8. An interactive video game system according to claim 5, wherein said game console means includes a housing and said sound synthesizer means and said sound position processing means are located in said housing.

9. An interactive video game system, including a single game cartridge and game console having a central processing unit, for displaying a video display on a video monitor and an audio synthesizer for producing an audio program associated with the video display, comprising:

a pair of audio transducers in spaced-apart relationship for reproducing the audio program;

said game cartridge containing interactive video game play data including visual display data and associated audio program data and further comprising sound positioning data of the kind for positioning a sound to seem to a listener to be at a point other than the locations of said pair of audio transducers, the visual display data, the audio program data, and the sound positioning data all being fed to the central processing unit;

first and second bus means;

a control unit including a housing for use by a player playing the interactive video game and connected to the game console, said pair of transducers being mounted on said control unit housing in spaced-apart relationship facing the player playing the video game;

a second, separate, sound synthesizer arranged in said control unit housing receiving the audio program data from the game cartridge through said first bus means from the central processing unit and producing at least one monaural sound signal therefrom within the audio frequency band; and sound position processing means also arranged within said control unit housing and connected to receive said at least one monaural sound signal from said second, separate, sound synthesizer over said second bus means and receiving said sound positioning data over said first bus means for producing therefrom two-channel audio output signals having differential amplitude and phase therebetween in accordance with a predetermined frequency dependent transfer function contained in said sound position processing means, said two-channel audio output signals being fed to said pair of audio transducers.

* * * * *